US010059477B2

(12) United States Patent
Benedetti et al.

(10) Patent No.: US 10,059,477 B2
(45) Date of Patent: Aug. 28, 2018

(54) HEAT SHRINK PACKAGING SYSTEM AND METHOD

(75) Inventors: Camila Benedetti, Indaiatuba (BR); Bassam Hallak, Newport (AU); Sjoerd J. Van Driesten, Bodegraven (NL)

(73) Assignee: Avery Dennison Corporation, Glendale, CA (US)

( * ) Notice: Subject to any disclaimer, the term of this patent is extended or adjusted under 35 U.S.C. 154(b) by 1162 days.

(21) Appl. No.: 13/697,393

(22) PCT Filed: May 12, 2011

(86) PCT No.: PCT/US2011/036187

§ 371 (c)(1),
(2), (4) Date: Nov. 12, 2012

(87) PCT Pub. No.: WO2011/143382

PCT Pub. Date: Nov. 17, 2011

(65) Prior Publication Data

US 2013/0055682 A1 Mar. 7, 2013

Related U.S. Application Data

(60) Provisional application No. 61/333,777, filed on May 12, 2010, provisional application No. 61/454,603, filed on Mar. 21, 2011.

(51) Int. Cl.
*B65B 53/02* (2006.01)
*B65B 61/02* (2006.01)
(Continued)

(52) U.S. Cl.
CPC ..... *B65B 61/025* (2013.01); *B65B 53/02* (2013.01); *B65C 3/00* (2013.01); *B65C 3/26* (2013.01);
(Continued)

(58) Field of Classification Search
CPC ..... B65B 53/00; B65B 53/02; B65B 61/025; B65B 61/02; B65C 3/00; B65C 3/02;
(Continued)

(56) References Cited

U.S. PATENT DOCUMENTS 3,468,736 A * 9/1969 Porter ..... B29C 65/04 156/182
3,523,052 A 8/1970 Bolen
(Continued)

FOREIGN PATENT DOCUMENTS

EP 0810087 7/2015
JP 62-19966 2/1987
(Continued)

OTHER PUBLICATIONS

International Search Report and Written Opinion dated Aug. 19, 2011 issued in corresponding IA No. PCT/US2011/036187 filed May 12, 2011.
(Continued)

*Primary Examiner* — Hemant M Desai
*Assistant Examiner* — Eduardo R Ferrero
(74) *Attorney, Agent, or Firm* — Avery Dennison Corporation

(57) ABSTRACT

A packaging system including a heat shrinkable flexible wall container and a heat shrinkable label is described. The label can be applied to the container prior to heat shrinking. Upon subjecting the labeled container containing the items or goods of interest to a heat shrink operation, the label and flexible wall container both undergo shrinking. The shrinkage characteristics of the flexible wall container and the label are matched to one another. Also described are various methods of packaging using the noted systems.

40 Claims, 2 Drawing Sheets

(51) Int. Cl.

| | |
|---|---|
| ***B65C 3/00*** | (2006.01) |
| ***B65C 3/26*** | (2006.01) |
| ***G09F 3/00*** | (2006.01) |
| *B65D 75/00* | (2006.01) |
| *G09F 3/02* | (2006.01) |

(52) U.S. Cl.
CPC ..... *G09F 3/0286* (2013.01); *B65D 75/002* (2013.01); *G09F 2003/0251* (2013.01)

(58) Field of Classification Search
CPC ..... B29C 2049/241; B29C 2049/2412; B32B 27/30; B32B 27/304; B32B 27/32; B32B 27/325; B32B 27/327; B32B 27/34; B32B 27/36; B65D 53/00
USPC ..... 53/415, 441, 442, 456; 428/34.9, 35.2
See application file for complete search history.

(56) References Cited

U.S. PATENT DOCUMENTS 3,589,091 A * 6/1971 Cloud ..... B65B 53/00 215/12.1
3,741,253 A * 6/1973 Brax ..... B29C 47/0023 138/137
3,924,051 A * 12/1975 Wiggins ..... B29C 47/0023 215/DIG. 2
4,057,667 A * 11/1977 Wiggins ..... B29C 47/0023 229/5.81
4,605,460 A * 8/1986 Schirmer ..... B32B 27/322 156/229
4,755,403 A 7/1988 Ferguson
4,800,129 A * 1/1989 Deak ..... B29C 51/002 428/474.4
4,854,850 A * 8/1989 Hautemont ..... B29C 51/167 264/509
4,975,313 A * 12/1990 Ezawa ..... B32B 27/32 428/213
5,017,125 A * 5/1991 Finnah ..... B29C 51/165 425/126.1
5,091,237 A * 2/1992 Schloegl ..... B29C 55/143 264/291
5,164,444 A 11/1992 Bernard
5,190,609 A * 3/1993 Lin ..... B32B 27/32 156/247
5,242,650 A * 9/1993 Rackovan ..... B29C 49/2408 156/244.11
5,264,532 A 11/1993 Bernard
5,398,427 A * 3/1995 Tolson ..... B65B 53/02 34/216
5,413,412 A * 5/1995 Odabashian ..... B29C 59/10 206/497
5,447,591 A * 9/1995 Ennis ..... B31B 19/90 156/229
5,462,756 A * 10/1995 Raines ..... B32B 27/08 426/127
5,482,771 A * 1/1996 Shah ..... B32B 27/08 428/349
5,492,950 A 2/1996 Brown et al.
5,546,677 A * 8/1996 Tolson ..... B65B 53/063 34/216
5,554,245 A * 9/1996 Schuhmann ..... B32B 27/32 156/244.24
5,556,674 A * 9/1996 Meilhon ..... B32B 27/08 206/497
5,563,205 A 10/1996 Mayer et al.
5,756,577 A * 5/1998 Gutierrez-Villarreal ..... C08J 5/18 428/35.1
5,766,795 A * 6/1998 Will ..... G09F 3/10 283/81
5,928,783 A * 7/1999 Phan ..... C08K 5/42 427/208.4
5,948,490 A * 9/1999 Raines ..... B29C 51/14 206/459.5
5,948,513 A * 9/1999 Turnbull ..... B32B 27/32 428/201
6,001,208 A * 12/1999 Kinoshita ..... B29C 49/24 156/245
6,004,682 A * 12/1999 Rackovan ..... B32B 27/08 428/515
6,146,726 A 11/2000 Yoshii et al.
6,183,791 B1 2/2001 Williams et al.
6,321,513 B1 * 11/2001 Meixner ..... B65B 45/00 53/434
6,322,883 B1 * 11/2001 Williams ..... B29C 55/023 428/308.4
6,461,706 B1 * 10/2002 Freedman ..... B32B 27/32 428/220
6,479,138 B1 * 11/2002 Childress ..... B32B 27/28 428/213
6,503,620 B1 * 1/2003 Xie ..... B32B 7/06 427/208.4
6,638,637 B2 * 10/2003 Hager ..... B32B 27/32 428/354
6,663,928 B2 * 12/2003 Ito ..... C08J 5/18 428/34.9
6,716,501 B2 * 4/2004 Kovalchuk ..... B32B 27/08 428/35.7
6,790,468 B1 * 9/2004 Mize, Jr. ..... B65D 75/004 426/129
6,908,687 B2 * 6/2005 Mendes ..... B32B 27/32 428/334
6,919,113 B2 * 7/2005 Therrian ..... B29C 55/023 156/244.11
7,255,903 B1 * 8/2007 Mudar ..... B65D 75/004 383/113
7,279,204 B2 * 10/2007 Ito ..... B29C 61/0608 428/34.9
7,335,327 B2 * 2/2008 Grah ..... C08J 5/18 264/342 R
7,807,255 B2 * 10/2010 Tsuchida ..... B32B 7/02 428/195.1
7,815,878 B1 * 10/2010 Wheatley ..... A63B 43/00 206/315.1
2002/0098303 A1 * 7/2002 Rackovan ..... B32B 27/32 428/34.9
2002/0157350 A1 * 10/2002 Dickey ..... B65B 53/02 53/411
2002/0192412 A1 * 12/2002 Satani ..... B32B 27/32 428/35.7
2003/0039775 A1 * 2/2003 Kong ..... B32B 27/36 428/34.9
2003/0106286 A1 * 6/2003 Rosloot ..... B65B 9/067 53/450
2003/0134062 A1 * 7/2003 Rajan ..... B32B 27/08 428/34.9
2004/0053022 A1 * 3/2004 Ohlsson ..... B31B 19/90 428/213
2004/0083680 A1 * 5/2004 Compton ..... B31B 19/90 53/133.6
2004/0237472 A1 * 12/2004 De Cardenas ..... B65B 61/205 53/399
2005/0183392 A1 * 8/2005 Lam ..... B29C 66/49 53/415
2006/0177612 A1 * 8/2006 Peterka ..... B32B 7/02 428/34.9
2007/0000983 A1 * 1/2007 Spurrell ..... B65D 81/3858 229/122.32
2007/0084557 A1 * 4/2007 Langseder ..... B29D 23/20 156/308.2
2007/0099017 A1 * 5/2007 Hayakawa ..... B32B 27/08 428/480
2007/0104931 A1 * 5/2007 Ito ..... B29C 61/003 428/220
2008/0026170 A1 * 1/2008 Yamada ..... B29C 61/003 428/34.9
2008/0044617 A1 * 2/2008 Schmitz ..... B29C 51/165 428/71

(56) References Cited

U.S. PATENT DOCUMENTS

| | | | | |
|---|---|---|---|---|
| 2008/0280111 | A1* | 11/2008 | Blackwell | B32B 27/32 428/200 |
| 2009/0056281 | A1* | 3/2009 | Murray | B65D 75/5883 53/455 |
| 2009/0211464 | A1* | 8/2009 | Till | B65B 61/025 100/2 |
| 2009/0297820 | A1* | 12/2009 | Kovalchuk | B29C 55/023 428/304.4 |
| 2011/0003096 | A1* | 1/2011 | Holbert | B32B 7/06 428/32.11 |
| 2011/0088354 | A1* | 4/2011 | Murgia Mendizabal | B65B 7/2885 53/399 |
| 2011/0189397 | A1* | 8/2011 | Langstaff | B29C 45/14688 427/256 |

FOREIGN PATENT DOCUMENTS

| | | |
|---|---|---|
| JP | 02-031412 | 8/1990 |
| KR | 10-2006-0038892 | 5/2006 |
| RU | 2006130853 | 3/2008 |

OTHER PUBLICATIONS

International Preliminary Report on Patentability dated Nov. 13, 2012 issued in corresponding IA No. PCT/US2011/036187 filed May 12, 2011.

* cited by examiner

HEAT SHRINK PACKAGING SYSTEM AND METHOD

CROSS REFERENCES TO RELATED APPLICATIONS

The present application is a 371 of International Application No. PCT/US2011/036187, which was published in English on Nov. 17, 2011, which claims the benefit of U.S. Provisional Application Nos. 61/333,777 filed May 12, 2010, and 61/454,603 filed Mar. 21, 2011, which are incorporated herein by reference in their entireties.

FIELD OF THE INVENTION

The present invention relates to heat shrinkable packaging systems that include a heat shrinkable flexible wall container or wrap, and a heat shrinkable label that can be applied to the container or wrap prior to shrinking. The invention also relates to methods of using the packaging and labeling systems.

BACKGROUND OF THE INVENTION

Heat shrinkable flexible wall containers such as bags or pouches, and heat shrinkable wrapping have been used extensively for packaging and/or encapsulating a wide array of goods. A prime application of heat shrinkable containers or wrap is packaging perishable food items such as red meats and poultry. Typically, a food item is placed within a heat shrinkable bag, air is removed or otherwise evacuated from the bag interior, the bag is sealed close, and the bag is then subjected to rapid heating in order to induce shrinkage of the bag about the bag contents, e.g. the food item. After packaging and shrinking, one or more paper or film labels are then applied to the exterior of the bag as desired to convey information such as bag contents, weight, expiration date, supplier, etc. As an alternative or in addition to applying paper or film labels, it is also known to print directly on the bag exterior after shrinking.

Applying paper or film labels or printing on the exterior of a shrunk bag or other flexible wall container is difficult and presents numerous issues. After shrinkage, the bag or flexible wall container typically exhibits an irregular contour corresponding to the contents of the bag or container. As will be appreciated, application and retention of labels to irregular non-planar surfaces is challenging and may require particular application techniques and adhesives or attachment strategies. Printing on irregular, non-planar surfaces is also particularly difficult.

In view of these and other issues, it would be desirable to provide a packaging system and method in which post-shrink labeling or printing could be avoided, yet whereby desired information and the like could be provided on the package exterior.

SUMMARY OF THE INVENTION

The difficulties and drawbacks associated with previously known systems are addressed in the present methods and systems for a packaging system having heat shrinkable components tailored to one another.

In one aspect, the present invention provides a method of labeling and packaging an item. The method comprises providing a shrinkable material and a shrinkable label. The method also comprises applying the label to the shrinkable material. The method additionally comprises enclosing an item to be packaged with the shrinkable material having the label applied thereto. And, the method comprises shrinking both the shrinkable material and the label about the item to thereby package the item.

In another aspect, the present invention provides a method of labeling and packaging an item. The method comprises obtaining a shrinkable flexible wall container defining an interior region and an exterior surface. The method also comprises applying a shrinkable label to the exterior surface of the flexible wall container. The method further comprises placing an item within the interior region of the flexible wall container and evacuating the interior region of the flexible wall container. And, the method also comprises shrinking both the flexible wall container and the label applied thereto.

In yet another aspect, the present invention provides a method of producing a packaging system that comprises providing a shrinkable flexible wall container having a first set of shrink characteristics and providing a shrinkable label having a second set of shrink characteristics. The method also comprises matching the first set of shrink characteristics of the flexible wall container with the second set of shrink characteristics of the label such that upon attaching the label to the flexible wall container and concurrently shrinking the flexible wall container and the label, both the flexible wall container and the label shrink to the same extent.

In still another aspect, the present invention provides a packaging system that comprises a shrinkable flexible wall container or wrap having a first set of shrink characteristics. The packaging system also comprises a shrinkable label having a second set of shrink characteristics. The first set of shrink characteristics and the second set of shrink characteristics are matched to one another.

And, in yet another aspect, the present invention provides a method of labeling and packaging an item. The method comprises providing a shrinkable material and a shrinkable label. The method also comprises applying the label to the shrinkable material. The method additionally comprises forming at least one of the label and the shrinkable material to thereby change its shape. The method further comprises enclosing an item to be packaged with the shrinkable material having the shrinkable label applied thereto. And the method comprises shrinking both the shrinkable material and the shrinkable label about the item, to thereby label and package the item.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
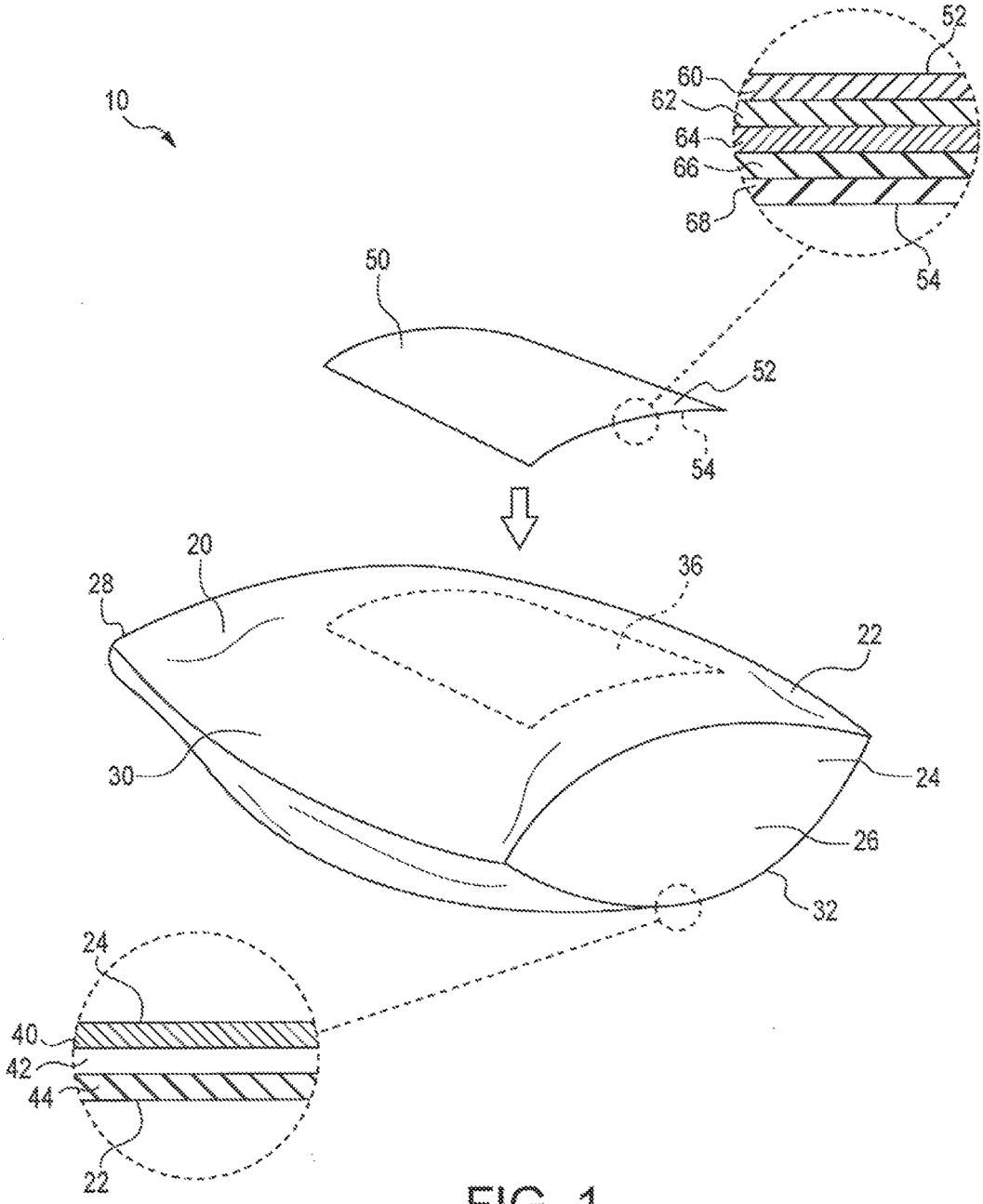
FIG. 1 is schematic illustration of a preferred embodiment packaging system in accordance with the present invention.

Preferably, the present invention provides a packaging system that comprises (i) a heat shrinkable flexible wall container or wrap, and (ii) a heat shrinkable label, label assembly, or other laminate. The heat shrinkable label or laminate and/or the heat shrinkable flexible wall container or wrap have heat shrink characteristics that are tailored to one another. Thus, the label can be applied to the flexible wall container or wrap, prior to shrinking. After affixment of the label, the resulting assembly of container or wrap and the label are concurrently subjected to a shrink operation. Preferably, the heat shrink characteristics of (i) the heat shrinkable flexible wall container or wrap, and (ii) the heat shrinkable label or laminate correspond to one another or substantially so, such that upon subjecting (i) and (ii) to an operation that induces shrinkage, the components (i) and (ii) undergo similar extents and/or rates of shrinkage. This ensures that shrinkage does not create undue stresses or physical deformation in (i) and/or (ii), and promotes intimate retention and contact between (i) and (ii). The heat shrinkable wrap and the heat shrinkable flexible wall container, each having a label applied thereto, can be subjected to one or more operations to achieve particular types of shrinkage such as skin-packaging as known in the art, and specific form shrink as also known in the art. Although the various components are generally described herein as being "heat shrinkable" and thus shrinking upon sufficient heating, it will be appreciated that the components and materials may also be shrinkable by other strategies and thus do not necessarily require heating to effect or induce shrinkage. Additional details and aspects of the preferred embodiment systems and methods are provided herein as follows.

Heat Shrinkable Flexible Wall Container or Wrap

A wide array of flexible wall containers, wrapping, films, and/or laminates can be used in the preferred embodiment packaging systems. The heat shrinkable flexible wall container or wrap preferably includes a biaxially oriented, heat shrinkable film. Biaxially oriented heat shrinkable films are typically produced by extruding or co-extruding polymers from a melt into a thick film, followed by a quick quenching and by orientation of the thick film by stretching the film under temperature conditions where molecular orientation of the film occurs and the film does not tear. Upon subsequent re-heating at a temperature close to the orientation temperature the film will tend to shrink, seeking to recover its original dimensional state. Biaxially oriented heat shrinkable films can be obtained by extruding or co-extruding the polymer(s) through a round die giving a tubular thick film typically referred to as "tape", that is immediately and quickly quenched by means of a water bath or cascade typically to about ambient temperature. The tape is then heated at the orientation temperature and stretched biaxially, while at this temperature, for example by a so-called "trapped bubble" technique that uses internal gas pressure to expand the diameter of the tape to form a large "bubble" and advancing the expanded tube at a faster rate than the extrusion rate so as to obtain transverse and machine directions of orientation respectively. Usually the stretch is at least about 3 times in each direction. The film is then cooled and rolled up in the cooled state so as to retain the property of heat shrinkability. The orientation temperature range generally depends on the type of polymers employed. The orientation temperature used for the manufacture of heat shrinkable films is in any case lower than the melting temperature of at least one polymer present in the film. Alternatively, biaxially oriented heat shrinkable films can be obtained by extruding the polymers through a flat die in the form of a sheet, and after a quenching step, heating the sheet to the orientation temperature and stretching the sheet. Longitudinal orientation is generally obtained by passing the sheet over at least two series of pull rolls wherein the second set runs at a higher speed than the first set. Crosswise or transversal orientation is generally performed in a tenter frame where the edges of the sheet are grasped by clips carried by two continuous chains running on two tracks that move wider apart as they progress. In an alternative method to a sequential stretching, i.e. either longitudinal first and then transversal or vice-versa, the stretching may be performed simultaneously in both directions. The stretched film is then cooled and rolled up as noted. Also in the case of orientation by a tenter frame, the stretch is usually at least about 3 times in each direction, but higher ratios are common.

The films used in the heat shrinkable flexible wall containers or wrapping used in the preferred embodiment packaging systems typically include multiple layers, the different layers providing the films with the physical and the mechanical properties required. In general, the films used for the manufacture of the heat shrinkable bags of the preferred packaging systems have a total thickness up to about 150 μm, preferably up to about 100 μm and even more preferably up to about 95 μm. Typically, the films have thicknesses from about 25 to about 150 μm, preferably from about 35 to about 100 μm and more preferably from about 35 to about 95 μm.

Generally, the heat shrinkable flexible wall containers or wrapping will shrink from about 1% to about 40%, more preferably from about 20% to about 40%, more preferably from about 25% to about 35%, and more preferably from about 30% to about 35%, in the longitudinal direction, and from about 1% to about 50%, more preferably from about 20% to about 50%, more preferably from about 30% to about 45%, and more preferably from 38% to 45%, in the transversal direction when heated at 85° C. However, it will be appreciated that in no way is the invention limited to these particular shrinkage extents. These shrinkage extents are periodically referred to herein as the shrinkage characteristics associated with the preferred embodiment flexible wall containers or wrapping.

Details as to the preferred temperatures and techniques for effecting shrinkage are described in detail herein in conjunction with descriptions of the preferred methods.

The flexible wall containers or wrapping typically exhibit a multilayer structure comprising a gas barrier layer, such as for instance a layer comprising PVDC, EVOH, a poly- or copolyamide, etc. as known in this field. Other layers may be present in order to provide the structure with the thickness and the mechanical properties required. The polyvinyl chloride (PVC), polystyrene, polyester, and polyolefin families of shrink films provide a wide range of physical and performance film characteristics. Film characteristics play an important role in the selection of a particular film and may differ for each type of packaging application. Polyolefins have been most successful with applications where moderate to high shrink forces are preferred. Polyolefin films are also used on automatic, high speed shrink wrapping equipment where shrink and sealing temperature ranges are more clearly controlled. Polyolefin films are particularly suitable for this application because polyolefin films tend to be cleaner, leaving fewer deposits and less residue, which extend the life of the equipment as well as reducing equipment maintenance. For many applications, polystyrene may also be preferred.

For packaging applications involving processed meat products, poultry, fresh red meat, cheeses and the like, the following layered assembly is particularly preferred for the shrinkable material, whether provided in the form of a flexible wall container, wrapping, web, stock, or sheet form. Preferably, a multi-layer film assembly is provided comprising at least a thermoplastic resin layer as an outermost layer (A), a gas barrier resin layer as a core layer (B) and a sealing resin layer as an innermost layer (C), and optionally an adhesive layer between the individual layers. The sealing resin layer of the innermost layer (C) is a layer formed of a resin material (a) comprising a linear ethylene-1-octene copolymer (b) and having an 1-octene content between from about 1 wt. % to about 20 wt. % and a density of from about 0.885 g/cm$^3$ to about 0.960 g/cm$^3$. An intermediate layer (D) formed of at least one resin selected from the group consisting of polyamide resins, thermoplastic polyester resins and ethylene copolymer resins is provided between the outermost layer (A) and the core layer (B). The intermediate layer (D) may also include at least one resin selected from the group consisting of polyamide resins, thermoplastic polyester resins and ethylene copolymer resins and also be provided between the core layer (B) and the innermost layer (C).

The resin material (a) forming the sealing resin layer of the innermost layer (C) may preferably be a resin material comprising 10-100 wt. % of the ethylene-1-octene copolymer (b) and 0-90 wt. % of at least one polymer selected from the group consisting of linear low density polyethylene (LLDPE), very low density polyethylene (VLDPE) and ethylene-1-octene copolymer elastomers and having an 1-octene content of 18 wt. % or higher and a density of 0.885 g/cm$^3$ or lower.

The thermoplastic resin forming the outermost layer (A) may preferably be at least one resin selected from the group consisting of polyolefin resins such as linear low density polyethylene (LLDPE) and very low density polyethylene (VLDPE); thermoplastic polyester resins such as copolyester (Co-PET); polyamide resins such as aliphatic nylon and aromatic nylon; and the ethylene-1-octene copolymer (b). In particular, when a layer of the ethylene-1-octene copolymer (b) is also provided as the outermost layer (A), a heat-shrinkable multi-layer film having excellent sealing properties, clarity and mechanical strength and excellent blocking resistance and slip property is provided. Additional details of this preferred construction and materials are provided in U.S. Pat. No. 6,146,726 and its EP equivalent EP 0810087.

Those skilled in the art will understand that a flexible wall container can have various shapes and can have rounded, straight or irregular edges, one or more of which are typically heat sealed. Bags or pouches typically include one or two factory seals, and one or two folded edges. One edge, the open mouth of the bag adapted to receive an article, is preferably heat sealed after loading the article into the bag. In addition, the invention includes the use of a single or multilayer heat shrinkable wrapping. In this version of the invention, the wrap is not formed into a package, bag, or pouch configuration. Instead, the wrap is in a sheet or roll form. During use, the wrap is positioned about the item or good to be packaged, and then sealed or otherwise affixed thereabout.

Heat Shrinkable Label

The preferred embodiment heat shrinkable label or label assembly may be in a variety of different forms and configurations. Preferably, the heat shrinkable label includes a heat shrink film layer and an adhesive layer for attaching the label to a substrate such as the previously noted heat shrinkable flexible wall container or wrap. The label assembly may also include a release layer covering an otherwise exposed face of the adhesive layer. And, the label assembly may further include a face or outer layer having suitable characteristics for receiving printing inks or other decorative layers. The label assembly can include additional strength-promoting layers as necessitated by the particular application.

As previously explained herein, the ability of a film to shrink upon exposure to heat arises from the orientation of the film during manufacture. During film manufacture, the films are typically heated to their orientation temperature range, which varies depending upon the particular polymers used for the films, but is usually above room temperature and below the melting temperature of the polymer. The film is then stretched, either sequentially or simultaneously, in the longitudinal or machine direction (MD) and in the cross or transverse direction (TD) to orient the film, as desired. After being stretched, the film is rapidly cooled, thus freezing the film in its biaxially oriented state. Upon heating, the orientation stresses are relaxed and the film will begin to shrink back to its original, unoriented dimension.

The polyvinyl chloride (PVC), polystyrene, polyester, and polyolefin families of shrink films provide a wide range of physical and performance film characteristics. Film characteristics play an important role in the selection of a particular film and may differ for each type of packaging or labeling application.

As previously noted, polyolefins have been most successful with applications where moderate to high shrink forces are preferred. Polyolefin films are also used on automatic, high speed shrink wrapping equipment where shrink and sealing temperature ranges are more clearly controlled. Polyolefin films are particularly suitable for this application because polyolefin films tend to be cleaner, leaving fewer deposits and less residue, which extend the life of the equipment as well as reducing equipment maintenance. However, it is contemplated that for many applications, particularly the packaging of food items or goods, polystyrene may be preferred.

The heat shrinkable label or label assembly typically include multiple layers and use a variety of different films depending upon the physical and mechanical properties required. Generally, the labels exhibit a total thickness of up to about 100 μm, and preferably from about 20 μm to about 90 μm.

The label or label assembly includes a film that shrinks from about 1% to about 40%, more preferably from about 20% to about 40%, more preferably from about 25% to about 35%, and more preferably from about 30% to about 35% in the longitudinal direction, and from about 1% to about 50%, more preferably from about 20% to about 50%, more preferably from about 30% to about 45%, and more preferably from about 38% to about 45% in the transversal position when heated at 85° C. It will be understood that in no way is the invention limited to these particular shrinkage extents. These shrinkage extents are periodically referred to herein as the shrinkage characteristics associated with the preferred embodiment labels.

Details as to the preferred temperatures for effecting shrinkage are described in detail herein in conjunction with descriptions of the preferred methods.

The heat shrinkable labels can be subjected to subsequent processing steps such as printing, metallizing, or laminating in order to fashion decorative or aesthetically appealing labels for use on containers.

As previously noted, the heat shrinkable label or label assembly includes a layer of adhesive along its underside for attaching the label to a region of the flexible wall container. As described in greater detail herein, the label is applied prior to shrinking, and is applied to the flexible wall container prior to shrinkage of that component. After adhesive affixment of the label to the flexible wall container, the two components are simultaneously or substantially so, subjected to one or more shrinking operations. As will be appreciated, operations that effect shrinkage typically involve heating and may also include use of steam and/or hot water. Accordingly, the adhesive selected should exhibit good performance and stability at elevated temperatures and upon exposure to high humidity and/or liquid water.

A wide array of adhesives can be used. Although not necessary, it is preferred that an effective amount of adhesive be carried with the label and disposed along an underside of the label assembly. In many applications, it is preferred that the adhesive and more particularly, an acrylic emulsion adhesive exhibiting relatively high water resistance properties be utilized. However, it will be appreciated that in no way is the invention limited to such adhesives. Instead, it is contemplated that the present invention packaging systems and in particular, the label assemblies, can utilize other adhesives and adhesive systems.

The preferred emulsion based pressure sensitive adhesives are based on a first emulsion polymer which contains, on a percent by weight basis, from about 95% to about 97.5% by weight total of at least one alkyl ester of acrylic acid containing about 1 to about 10 carbon atoms in the alkyl group. Useful alkyl acrylates include n-butyl acrylate, 2-ethyl hexyl acrylate, isooctyl acrylate and the like. Butyl acrylate, 2-ethyl hexyl acrylate and mixtures thereof are preferred. Butyl acrylate is most preferred.

The second monomeric component is a one or more $\alpha\beta$ unsaturated carboxylic acid present in a total amount of at least about 2.5% by weight, preferably from about 2.5 to about 5% by weight.

The unsaturated carboxylic acid may contain from about 3 to about 5 carbon atoms and includes among others, acrylic acid, methacrylic acid, itaconic acid and the like. Mixtures of acrylic acid and methacrylic acid in a respective weight ratio of about 1:1 to about 1:3, preferably from about 1:1 to about 1:2 are preferred. Additional details of preferred adhesives are found in one or more of U.S. Pat. Nos. 5,492,950; 5,563,205; 5,264,532; and 5,164,444.

Preferably, the shrink characteristics of the heat shrinkable label and the heat shrinkable flexible wall container or wrap are tailored to one another or "matched" such that upon being subjected to a shrinking operation, the label and container exhibit similar degrees and/or rates of shrinkage. The term "matched" as used herein refers to selecting, producing, or otherwise designing the heat shrinkable label to exhibit equivalent shrink characteristics as the heat shrinkable flexible wall container or wrap such that when the components are simultaneously subjected to a shrinking operation, no undue stresses or material deformations are induced which result in disruption along the interface between the components. Thus, no wrinkles, peel-up, or distortion are exhibited in the label or in regions of the flexible wall container adjacent the label. The term "matched" also refers to selecting, producing, or otherwise designing the heat shrinkable flexible wall container or wrap to exhibit equivalent shrink characteristics as the heat shrinkable label. And, the term "matched" also includes selecting, producing, or otherwise designing both the heat shrinkable flexible wall container or wrap, and the heat shrinkable label to exhibit equivalent shrink characteristics to one another. More specifically, the term "matched" refers to one of the components of the packaging system, i.e. the flexible wall container or the label, to exhibit a shrinkage extent that is from about 90% to about 110% of the extent of shrinkage of the other component. For example, for a biaxially oriented heat shrinkable flexible wall container that exhibits a shrink of 30% in the longitudinal direction and about 32% in the transversal direction, the heat shrinkable label is matched by tailoring the label and selecting materials for use therein such that the label is biaxially oriented and exhibits a shrink of from about 27% to about 33% in the longitudinal direction and a shrink of from about 28.8% to about 35.2% in the transversal direction. More preferably, the shrinkages of the components are within 95% to 105% of each other, more preferably within 98% to 102% of each other, and most preferably are about 100% or equivalent to one another.

It will be appreciated that the present invention is not limited to, or based upon, any particular phenomena concerning the relationship between the shrinkable flexible wall container or wrap, and the shrinkable label. That is, although the invention can be conveniently characterized as selectively and/or designing these components relative to one another such that their shrinkage extents are matched, the invention also includes systems in which the shrink forces are balanced with the bonding forces. For example, it is contemplated that the invention includes a system of a shrinkable flexible wall container and a shrinkable label having characteristics such that upon bonding the label to the flexible wall container and shrinking both components, no wrinkles, peel-up, or distortion are exhibited in the label or regions of the flexible wall container adjacent the label because the shrink forces associated with the flexible wall container and the label are balanced with the bonding forces between those components.

Packaging System

The present invention also provides a packaging system that comprises the previously noted shrinkable flexible wall container or wrap, and the shrinkable label assembly. These two components can be supplied in conjunction with one another to an end-user such as a food processor, packaging entity, or other end user. The packaging system will find wide application in a variety of industries as exemplified by the following description concerning its use and associated methods.

Methods

The present invention provides a wide range of methods and processes for packaging goods by use of the systems described herein. Generally, a preferred embodiment method involves obtaining a heat shrinkable flexible wall container having appropriate size, configuration, and characteristics for the good(s) to be packaged or retained therein. One or more heat shrinkable labels or other laminate assemblies as described herein are appropriately selected and/or matched and applied to the flexible wall container as desired. Typically, effective amounts of adhesive are used to adhere the label to an exterior region of the container. The labeled container is then filled or otherwise introduced with the item(s) to be placed therein. After evacuation of air and/or fluids from the interior of the container, the container is sealed. Although heat sealing is typically used, other sealing methods can be used such as adhesive sealing, sonic welding, and/or mechanical sealing techniques. Typically, an evacuation operation conventionally known as vacuum packing can be used. The sealed, labeled flexible wall container containing the item(s) of interest is then subjected to one or more operations to concurrently shrink both the flexible wall container and the label. Typically, shrinkage can be effected by exposure to elevated temperatures, such as from about 70° C. to about 99° C., and preferably from about 85° C. to about 92° C., for a time period of from about 0.1 seconds to 5 or more seconds and preferably from about 1.5 seconds to 2 seconds. It will be appreciated that in no way is the invention limited to these particular temperatures and/or times. Instead, it is contemplated that depending upon the materials used in the heat shrinkable flexible wall container and the heat shrinkable label assembly, temperatures less than 70° C. or greater than 99° C. could be used to shrink the noted components. In addition, exposure times different than the preferred range noted could be utilized. Moreover, a wide array of heating strategies can be used to induce shrinkage, and thus in no way is the invention limited to heating by exposure to steam or hot water. For example, exposure to hot air or other gas flows could be used. And, various process equipment or operations can be employed to effect shrinkage such as for example steam tunnels, hot fluid containers, etc.

In addition, it is also contemplated that a method of labeling and packaging an item or other good(s) can utilize a series of operations in which a heat shrinkable label or label assembly is applied to a heat shrinkable material such as in sheet or web form, and after label application, the heat shrinkable material is then formed into a flexible wall container such as a bag or pouch. Preferably, such a method comprises providing a heat shrinkable material and a heat shrinkable label or label assembly. The label is then applied to the heat shrinkable material at a desired location. As described herein, adhesive application is preferred. Next, one or more item(s) to be packaged are then enclosed using the heat shrinkable material. This can be achieved in several fashions such as by wrapping the item in the heat shrinkable material. Another approach is to form a flexible wall container as described herein from the heat shrinkable material having the label applied thereto and then placing the item(s) within the flexible wall container. After appropriately enclosing the item(s) with the heat shrinkable material having the label applied thereto, the heat shrinkable material and the label are subjected to one or more operations to affect shrinkage about the item(s).

Furthermore, it is also contemplated that other strategies could be performed to induce shrinkage, besides heating. For example, it is also contemplated that other techniques may be utilized to induce shrinkage of the flexible wall container and/or the label. For example, exposure to electromagnetic radiation and in particular infra-red radiation or microwave radiation could be utilized to induce shrinkage.

The present invention also provides methods of producing a packaging system. These methods involve providing a heat shrinkable flexible wall container and a heat shrinkable label. The flexible wall container and/or the label are selected such that their heat shrink characteristics match one another as described herein. This ensures that upon attachment of the label to the flexible wall container prior to shrinkage of either, followed by shrinkage, both the label and the flexible wall container undergo equivalent extents of shrinkage.

FIG. 1 schematically illustrates a preferred embodiment packaging system 10 in accordance with the present invention. The preferred embodiment system 10 comprises a heat shrinkable flexible wall container 20 and a heat shrinkable label assembly 50, as follows. The flexible wall container 20 defines an exterior surface 22 and an interior surface 24 that in turn defines an interior region 26 within the container 20. The flexible wall container 20 can include one or more sealed regions 28 and/or sidewalls 30, and initially, at least one open region 32 through which the interior region 26 can be accessed. The flexible wall container 20 includes a heat shrinkable film layer 42, an optional barrier layer 40, and one or more optional outer layer(s) 44 or intermediate layers (not shown). The label assembly 50 defines an exterior face 52 and an oppositely directed underside or interior face 54. Upon positioning and attaching the label assembly 50 to the flexible wall container 20, such as at a target location 36 defined along the exterior surface 22 of the container 20, the interior face 54 of the label 50 is preferably directed toward the exterior surface 22 of the container 20. The label assembly 50 comprises a heat shrinkable film layer 62, an optional outer layer 60, and one or more secondary layers such as secondary layer 64. The label assembly 50 also includes an adhesive layer 66 and a release layer 68 contacting the otherwise exposed face of the adhesive layer 66.

Figure 2:
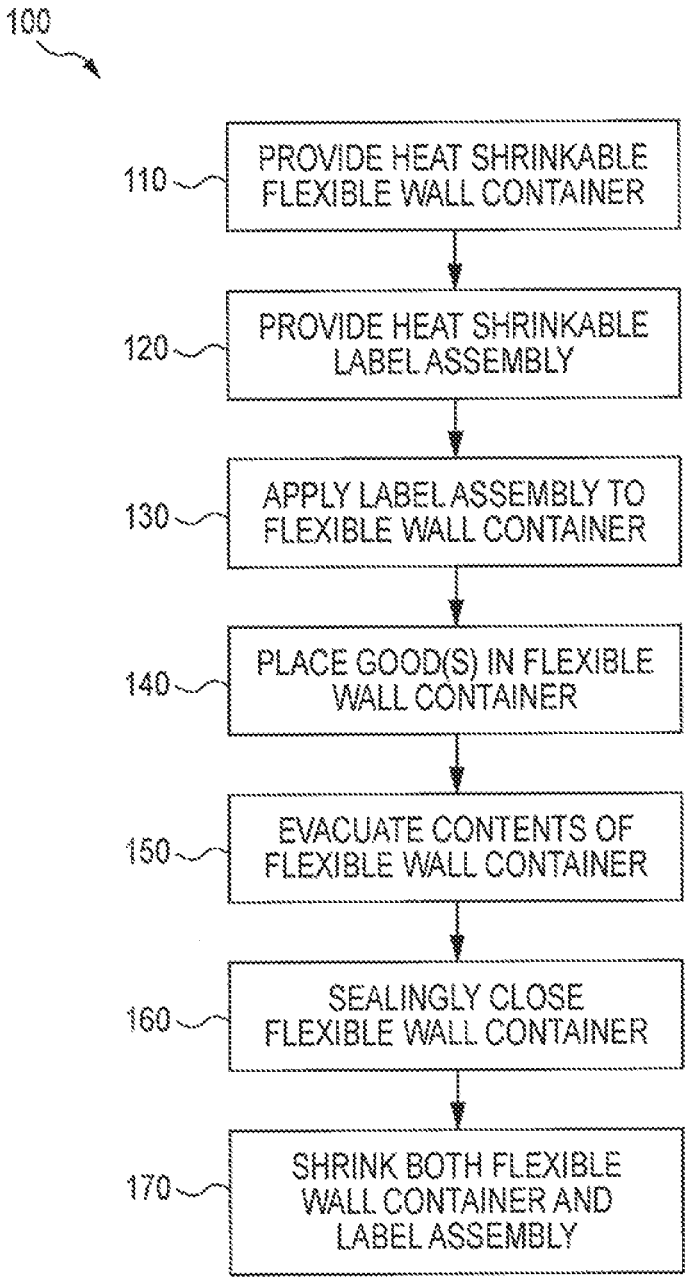
FIG. 2 is a block diagram illustrating a preferred embodiment process in accordance with the present invention.

FIG. 2 is a block diagram of a preferred embodiment process 100 in accordance with the present invention. The process 100 generally comprises an operation 110 of providing a heat shrinkable flexible wall container as described herein. The process 100 also comprises an operation 120 of providing a heat shrinkable label assembly as described herein. It will be appreciated that these steps can be performed in a reverse order or performed concurrently. The process 100 also comprises an operation 130 of applying the label assembly to the flexible wall container. Typically this operation is performed by use of an effective amount of adhesive disposed between the label and the flexible wall container. For the preferred embodiment system 10 depicted in FIG. 1, this operation is performed by removing the release layer 68 of the label assembly 50 to thereby expose a face of the adhesive layer 66. The adhesive face is then contacted with the flexible wall container to adhere the label thereto. The preferred process 100 also comprises an operation 140 of placing one or more goods or items within the flexible wall container. The process 100 further comprises operations 150 and 160 in which the flexible wall container is sealed and its contents such as air are evacuated, followed by sealing close the container. It will be understood that the operations 150 and 160 can be performed in reverse order or can be performed concurrently or substantially so, with each other. It is contemplated that conventional vacuum packaging methods can be utilized for operations 150 and 160. The process 100 also comprises an operation 170 in which both the flexible wall container and the label assembly are heated or otherwise exposed to elevated temperatures to cause shrinkage of both the flexible wall container and the label assembly. Preferably, these components undergo shrinking concurrently with each other. A variety of techniques can be employed to effect shrinkage of the flexible wall container and the label assembly. Preferably, shrinking is achieved by heating by immersing or exposing the components to water having a temperature of from about 70° C. to about 99° C., for a time period of from about 0.1 seconds to about 5 seconds. It will be understood that in no way is the present invention limited to this form of heating to cause shrinkage. After performing operation 170, the items or goods within the interior of the container are sealed and generally protected from external agents and/or factors.

Another preferred embodiment method of the present invention is utilizing a forming operation prior to heat shrinking the package and label applied thereto. For example, in this preferred embodiment method, a heat shrink label as previously described herein, is applied to a plastic formable web or equivalent material. The plastic material is preferably heat shrinkable also. The label and plastic sheet, tray, or container to house the good(s) of interest, are then subjected to a forming operation in which the plastic sheet, tray, or container is deformed or otherwise modified in shape to better receive or accommodate the good(s) of interest. During the forming operation, the label may also be deformed. Preferably, the forming operation is a thermoforming operation. Once the label and plastic sheet, tray, or container have been appropriately formed, the goods to be packaged are placed in or on the thermoformed assembly. The resulting packaged product or goods is then subjected to a shrinking operation in which the label and the plastic sheet, tray, or container are heat shrunk to thereby enclose and seal the package.

It will be understood that the present invention and various preferred embodiments can be used in conjunction with form shrink materials and/or form shrink packaging systems. Generally, form shrink involves providing a package mold or a thermoformed packet. The loading of the package or packet is performed so that a strong sealing seam is formed typically without overlapping film edges. The film and seal are closely cut to fit the package. At the last stage of the packaging system, the film is shrunk, typically in a heated tank. In a preferred form shrink process, a heat shrinkable web, which is typically a multilayer laminate, is provided. One or more heat shrinkable labels are optionally applied to the laminate. The laminate along with any applied labels is then thermoformed to a desired shape. Typically, the shape to which the laminate is thermoformed corresponds to the shape of the article or package to be sealed. After suitably shaping the laminate, a thermoformed packet is formed. The article(s) are then placed within the thermoformed packet. A first web is sealed to a second web to thereby enclose the article(s) within the thermoformed packet. Preferably, concurrently with this sealing operation, vacuum lamination is performed to evacuate the contents of the packet or interior region within which the article(s) are disposed. At this stage, another heat shrinkable label and preferably a pressure sensitive label can be applied to the outer surface of the packet or resulting package. Preferably, the packet or package is then subjected to heat to thereby shrink the web(s) and label(s). Preferably, application of water having a temperature of about 85° C. to about 92° C. can be performed.

Many other benefits will no doubt become apparent from future application and development of this technology.

All patents, published applications, and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present invention solves many problems associated with previously known systems and methods. However, it will be appreciated that various changes in the details, materials and arrangements of components, which have been herein described and illustrated in order to explain the nature of the invention, may be made by those skilled in the art without departing from the principle and scope of the invention, as expressed in the appended claims.

What is claimed is:

1. A method of labeling and packaging an item, the method comprising:

providing a shrinkable material having at least one layer comprising a heat shrinkable film layer;

providing a shrinkable label;

applying the shrinkable label to the shrinkable material, wherein the shrinkable label does not completely cover the shrinkable material;

enclosing an item to be packaged with the shrinkable material having the shrinkable label applied thereto;

shrinking both the shrinkable material and the shrinkable label about the item, to thereby label and package the item, wherein the shrinking is performed by exposing the shrinkable material and the shrinkable label to temperatures from about 70° to about 99° C. for a time period of from about 0.1 seconds to about 5 seconds, and wherein the shrinkable label exhibits a label shrinkage extent that is less than 110% of a material shrinkable extent of the shrinkable material.

2. The method of claim 1 wherein the method further comprises:

after applying the shrinkable label to the shrinkable material, forming a shrinkable flexible wall container defining an interior region;

wherein enclosing includes placing the item within the interior region defined by the shrinkable flexible wall container.

3. The method of claim 1 wherein applying the shrinkable label to the shrinkable material is performed by adhesively adhering the label to the exterior surface of the material.

4. The method of claim 1 wherein the shrink forces associated with the shrinkable material and the shrinkable label are balanced with bonding forces between the shrinkable material and the shrinkable label.

5. The method of claim 1 wherein the time period is from 1.5 seconds to 2 seconds.

6. The method of claim 1 wherein shrinking of the shrinkable material and the shrinkable label occur simultaneously.

7. The method of claim 1 wherein both the shrinkable material and the shrinkable label include at least one layer comprising a heat shrinkable film layer.

8. The method of claim 7 wherein the heat shrinkable film layer comprises a material selected from the group consisting of polyvinyl chloride, polystyrene, polyester, polyolefin, and combinations thereof.

9. The method of claim 1 wherein upon shrinking both the shrinkable material and the shrinkable label, the material and the label undergo equivalent extents of shrinkage.

10. The method of claim 1 wherein upon shrinking both the shrinkable material and the shrinkable label, the material shrinks from about 1% to about 40% in a first direction and shrinks from about 1% to about 50% in a second direction transverse to the first direction.

11. The method of claim 1 wherein upon shrinking both the shrinkable material and the shrinkable label, the material shrinks from about 20% to about 40% in a first direction and shrinks from about 20% to about 50% in a second direction transverse to the first direction.

12. The method of claim 1 wherein the shrinkable label shrinks from greater than 90% to less than 110% of the extent of the shrinkable material in a first direction and shrinks from greater than 90% to less than 110% of the extent of the shrinkable material in a second direction transverse to the first direction.

13. The method of claim 1 wherein the shrinkable material further includes a barrier layer.

14. The method of claim 13 wherein the shrinkable material also includes one or more additional layers.

15. The method of claim 1 wherein the shrinkable label includes a layer of biaxially oriented heat shrinkable film material.

16. The method of claim 15 wherein the shrinkable label further includes an adhesive layer.

17. The method of claim 16 wherein the shrinkable label further includes a release layer contacting the adhesive layer.

18. The method of claim 15 wherein the shrinkable label further includes one or more additional layers.

19. The method of claim 1 wherein the shrinkable label comprises printed material.

20. The method of claim 1, wherein the label shrinkage extent and the material shrinkage extent are within 95% to 105% of one another.

21. A method of labeling and packaging an item, the method comprising:

providing a shrinkable material having at least one layer comprising a heat shrinkable film layer;

providing a shrinkable label;

applying the shrinkable label to the shrinkable material, wherein the shrinkable label does not completely cover the shrinkable material;

forming at least one of the label and the shrinkable material to thereby change its shape;

enclosing an item to be packaged with the shrinkable material having the shrinkable label applied thereto; and shrinking both the shrinkable material and the shrinkable label about the item, to thereby label and package the item, wherein the shrinking is performed by exposing the shrinkable material and the shrinkable label to temperatures from about 70° to about 99° C. for a time period of from about 0.1 seconds to about 5 seconds, and wherein the shrinkable label exhibits a label shrinkage extent that is less than 110% of a material shrinkage extent of the shrinkable material.

22. The method of claim 21 wherein the forming is performed by thermoforming.

23. The method of claim 21 wherein applying the shrinkable label to the shrinkable material is performed by adhesively adhering the label to the exterior surface of the material.

24. The method of claim 21 wherein shrink forces associated with the shrinkable material and the shrinkable label are balanced with bonding forces between the shrinkable material and the shrinkable label.

25. The method of claim 21 wherein the time period is from 1.5 seconds to 2 seconds.

26. The method of claim 21 wherein shrinking of the shrinkable material and the shrinkable label occur simultaneously.

27. The method of claim 21 wherein both the shrinkable material and the shrinkable label include at least one layer comprising a heat shrinkable film layer.

28. The method of claim 27 wherein the heat shrinkable film layer comprises a material selected from the group consisting of polyvinyl chloride, polystyrene, polyester, polyolefin, and combinations thereof.

29. The method of claim 21 wherein upon shrinking both the shrinkable material and the shrinkable label, the material and the label undergo equivalent extents of shrinkage.

30. The method of claim 21 wherein upon shrinking both the shrinkable material and the shrinkable label, the material shrinks from about 1% to about 40% in a first direction and shrinks from about 1% to about 50% in a second direction transverse to the first direction.

31. The method of claim 21 wherein upon shrinking both the shrinkable material and the shrinkable label, the material shrinks from about 20% to about 40% in a first direction and shrinks from about 20% to about 50% in a second direction transverse to the first direction.

32. The method of claim 21 wherein the shrinkable label shrinks from greater than 90% to less than 110% of the extent of the shrinkable material in a first direction and shrinks from greater than 90% to less than 110% of the extent of the shrinkable material in a second direction transverse to the first direction.

33. The method of claim 21 wherein the shrinkable material further includes a barrier layer.

34. The method of claim 33 wherein the shrinkable material also includes one or more additional layers.

35. The method of claim 21 wherein the shrinkable label includes a layer of biaxially oriented heat shrinkable film material.

36. The method of claim 35 wherein the shrinkable label further includes an adhesive layer.

37. The method of claim 36 wherein the shrinkable label further includes a release layer contacting the adhesive layer.

38. The method of claim 35 wherein the shrinkable label further includes one or more additional layers.

39. The method of claim 21 wherein the shrinkable label comprises printed material.

40. The method of claim 21, wherein the label shrinkage extent and the material shrinkage extent are within 95% to 105% of one another.

* * * * *